US010260307B2

(12) United States Patent
Godfrey et al.

(10) Patent No.: US 10,260,307 B2
(45) Date of Patent: Apr. 16, 2019

(54) DRILL TOOL INSERT REMOVAL

(71) Applicant: Halliburton Energy Services, Inc., Houston, TX (US)

(72) Inventors: Craig William Godfrey, Dallas, TX (US); Owen Ransom Clark, Dallas, TX (US); Derrick W. Lewis, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 207 days.

(21) Appl. No.: 15/103,137

(22) PCT Filed: Dec. 30, 2013

(86) PCT No.: PCT/US2013/078305

§ 371 (c)(1),
(2) Date: Jun. 9, 2016

(87) PCT Pub. No.: WO2015/102577

PCT Pub. Date: Jul. 9, 2015

(65) Prior Publication Data

US 2016/0305213 A1 Oct. 20, 2016

(51) Int. Cl.
*E21B 23/08* (2006.01)
*E21B 33/08* (2006.01)
(Continued)

(52) U.S. Cl.
CPC ..... *E21B 33/085* (2013.01); *E21B 21/015* (2013.01); *E21B 23/08* (2013.01); *E21B 33/06* (2013.01)

(58) Field of Classification Search
CPC ..... E21B 33/06; E21B 33/068; E21B 33/08; E21B 33/085; E21B 23/08
See application file for complete search history.

(56) References Cited

U.S. PATENT DOCUMENTS 3,628,604 A * 12/1971 Childers ..... E21B 33/0415 166/338
7,080,685 B2 7/2006 Bailey et al.
(Continued)

FOREIGN PATENT DOCUMENTS

WO WO-2015/102577 A1 7/2015

OTHER PUBLICATIONS

"International Application Serial No. PCT/US2013/078305, International Search Report dated Oct. 8, 2014", 4 pgs.
(Continued)

*Primary Examiner* — Brad Harcourt
*Assistant Examiner* — David Carroll
(74) *Attorney, Agent, or Firm* — Gilliam IP PLLC

(57) ABSTRACT

A tool insert is removable from a fluid passage in a drill tool body by pressurizing fluid in a removal volume defined between the tool insert and the drill tool body, to by exerting a net fluid pressure bias on the tool insert in a removal direction along the fluid passage. The tool insert can be an annulus sealing assembly mounted in a rotating control device (RCD), with the removal volume being defined radially between a body of the RCD and a bearing assembly of the annulus sealing assembly. A common hydraulic liquid may be used for lubricating the bearing assembly and for hydraulically actuated removal of the annulus sealing assembly.

22 Claims, 9 Drawing Sheets

(51) Int. Cl.
*E21B 21/015* (2006.01)
*E21B 33/06* (2006.01)

(56) References Cited

U.S. PATENT DOCUMENTS

| | | | | |
|---|---|---|---|---|
| 7,487,837 | B2 | 2/2009 | Bailey et al. | |
| 8,381,816 | B2 | 2/2013 | Leduc et al. | |
| 2001/0045286 | A1* | 11/2001 | Pallini | E21B 33/038 166/345 |
| 2005/0161224 | A1 | 7/2005 | Starr et al. | |
| 2008/0105462 | A1 | 5/2008 | May et al. | |
| 2008/0210471 | A1 | 9/2008 | Bailey et al. | |
| 2010/0218952 | A1 | 9/2010 | Robertson | |
| 2011/0214871 | A1* | 9/2011 | Leduc | E21B 17/01 166/311 |
| 2012/0000664 | A1* | 1/2012 | Nas | E21B 33/085 166/344 |
| 2014/0238686 | A1 | 8/2014 | Boyd | |

OTHER PUBLICATIONS

"International Application Serial No. PCT/US2013/078305, Written Opinion dated Oct. 8, 2014", 6 pgs.

* cited by examiner

DRILL TOOL INSERT REMOVAL

PRIORITY APPLICATION

This application is a U.S. National Stage Filing under 35 U.S.C. 371 from International Application No. PCT/US2013/078305, filed on 30 Dec. 2013, and published as WO 2015/102577 A1 on 9 Jul. 2015, which applications and publication are incorporated herein by reference in their entirety.

TECHNICAL FIELD

This application relates generally to tools used in drilling operations, and to methods of operating a drill tool.

BACKGROUND

When drilling for oil and gas, a drill string is progressively assembled from the surface by consecutively adding segments of drill pipe, while a drill bit at the bottom of the drill string is rotated to form a wellbore. Drilling fluid is pumped downhole through the drill string and up through an annulus surrounding the drill string. A device such as a Rotating Control Devices (RCD) may be used to seal the annulus for closed-annulus drilling operations, such as managed pressure drilling, underbalanced drilling, mud cap drilling, pressurized mud cap drilling, air drilling, and mist drilling. RCDs can also be used as additional safety barriers when drilling conventionally.

RCDs divert drilling fluid (e.g., drilling mud) returning from a well to separators, chokes, and/or other pieces of equipment in a drilling system, rather than up through a flow nipple to a rig floor as in more traditional and common overbalanced drilling. The RCD is in such cases generally mounted above blowout protectors (BOPs) and below the rig floor. The RCD can be installed directly above a drilling annular or in a riser on floating drilling units above or below a tension ring. In some instances, and RCD device is placed in a riser extending between the ocean floor and the surface.

An RCD includes a rotatable sealing element typically carried by a bearing assembly. The sealing element usually comprises an annular elastomeric part (typically of rubber, nitrile, polyurethane, or the like) having an internal diameter sized to seal around the drill pipe and a cage used to provide structural support and to attach to the bearing assembly. The element seals around the drill pipe and is sufficiently compliant to maintain sealing as the drill pipe is rotated and to accommodate a varying diameter of the drill string, such as to pass drill pipe joints, as the drill string is lowered or raised. In some RCDs, the seal rotates with the drill string and in other RCDs the sealing element remains stationary.

As drill pipe is run through the sealing elements and rotated, the elastomers of the elements progressively wear. Rotary seals between rotating and stationary parts of the bearing assembly also wear. Maintenance of the RCD therefore requires regular replacement of these items. The most common method of replacing such annulus sealing assembly components on a wellhead is to remove the entire annulus sealing assembly (with bearing assembly rotary seals and the sealing elements) and replace the worn parts with a redressed bearing assembly carrying fresh sealing elements. This allows the rig to quickly change over from the used annulus sealing assembly to a new one and allows the elements and rotary seals to be replaced and redressed on the used annulus sealing assembly at leisure and with a proper setup of tools, fixtures, lighting, spare parts, and so forth.

During the course of operations, however, drilling mud and cuttings flow around the seals and other closely separated components of the RCD. Over time, material can tend to build up in spaces between separate parts of the annulus sealing assembly and/or the RCD body, thus causing the parts to become seized, cemented, or stuck together. In such cases, use of a pulling tool may sometimes be required to forcibly remove a bearing assembly stuck in the body of the RCD.

BRIEF DESCRIPTION OF THE DRAWINGS

Some embodiments are illustrated by way of example and not limitation in the figures of the accompanying drawings in which.

DETAILED DESCRIPTION

Figure 1:
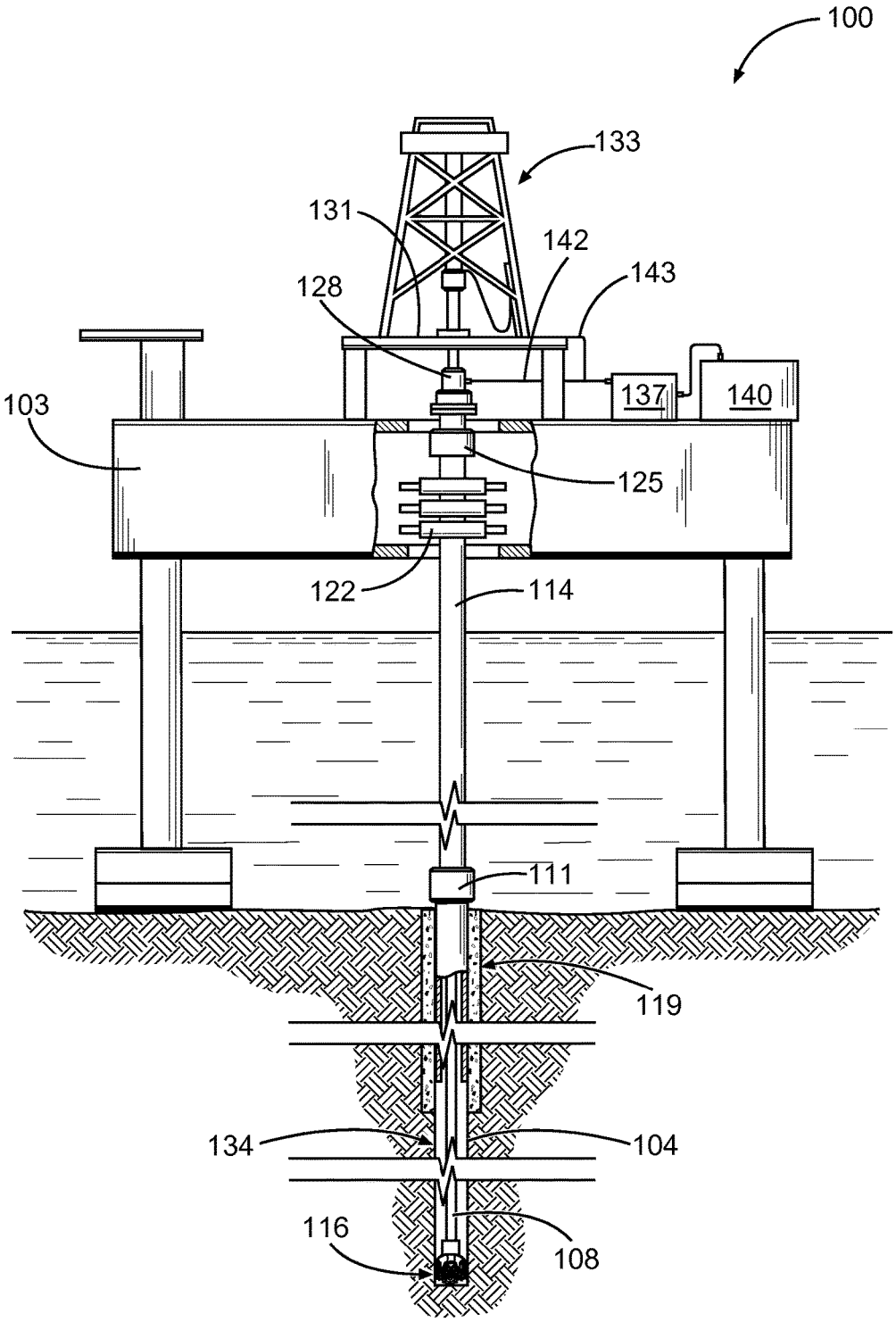
FIG. 1 depicts a schematic diagram of a drilling system comprising a drilling installation in the example form of an offshore rig that includes a drill tool in the form of an RCD in accordance with an example embodiment

The following detailed description refers to the accompanying drawings that depict various details of examples selected to show how the disclosed subject matter may be practiced. The discussion addresses various examples of the disclosed subject matter at least partially in reference to these drawings, and describes the depicted embodiments in sufficient detail to enable those skilled in the art to practice the disclosed subject matter. Many other embodiments may be utilized for practicing the disclosed subject matter other than the illustrative examples discussed herein, and structural and operational changes in addition to the alternatives specifically discussed herein may be made without departing from the scope of the disclosed subject matter.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

One aspect of the disclosure comprises a method of tool insert from a passage in a drill tool body, the method comprising exerting a net axial fluid pressure force on the tool insert by pressurizing fluid in a removal volume defined between the tool insert and the drill tool body. The pressurized fluid in the removal volume thus acts between the drill tool body and the tool insert to push the tool insert through fluid pressure action axially in a removal direction, to displace the insert assembly from its mounted position, or to assist axial removal by use of a removal tool, such as a pulling tool.

Tool inserts are components or assemblies that are designed and configured for removable and replaceable mounting in a drill tool body. Example tool inserts include an annulus sealing assembly for sealing a drilling fluid annulus defined between an outer diameter of a drill string and an inner diameter of a fluid passage in the drill tool body, and a bore protector comprising a cylindrical sleeve to serve as a protective liner for the inner diameter of the fluid passage.

In embodiments where the tool insert is an insert assembly comprising a bearing assembly and rotary components supported rotationally in the drill tool body via the bearing assembly (e.g. comprising a seal assembly having one or more sealing elements rotationally mounted in a drilling fluid conduit via a bearing assembly) the removal volume may be defined between the bearing assembly and the drill tool body, so that the net axial fluid pressure force for net fluid pressure bias acts on the bearing assembly. The removal volume may be a substantially annular space defined between the drill tool body and a generally tubular bearing housing that forms part of the bearing assembly. "Tubular" means substantially hollow cylindrical, and encompasses both circular and non-circular cross-sectional profiles for the inner and outer diameters of the relevant element. A pipe or substantially cylindrical space, for example, of which the inner diameter and/or the outer diameter is noncircular (e.g., hexagonal) is tubular in shape.

The particular fluid employed for pressurizing the removal volume may be a hydraulic fluid distinct from a drilling fluid that flows through a drilling fluid conduit of which of the passage in the drill tool body may form part, in some embodiments comprising a hydraulic medium, such as lubrication oil, while in other embodiments, the fluid may be a pneumatic medium, such as pressurized nitrogen gas.

FIG. 1 is a schematic view of an example embodiment of a system 100 in which a method of removing an insert assembly from a passage in a drill tool body, in accordance with one embodiment. The system 100 comprises a drilling installation that includes an offshore floating semisubmersible drill rig 103 which is used to drill a subsea borehole 104 by means of a drill string 108 suspended from and driven by the drill rig 103. In other embodiments, the disclosed method and apparatus made be used in different drill rig configurations, including both offshore and land drilling.

The drill string 108 comprises sections of drill pipe suspended from a drilling platform 133 on the drill rig 103. A downhole assembly or bottom hole assembly (BHA) at a bottom end of the drill string 108 includes a drill bit 116 which is driven at least in part by the drill string 108 to drill into Earth formations, thereby piloting the borehole 104. Part of the borehole 104 may provide a wellbore 119 that comprises a casing hung from a wellhead 111 on the seafloor. A marine riser 114 extends from the wellhead 111 to the drill rig 103, with a blowout preventer (BOP) stack 122 positioned on top of the riser. In this example embodiment, an annular BOP 125 is located on top of the BOP stack 122, and a rotating control device (RCD) 128 is positioned above the annular BOP 125, below a rig floor 131 provided by the drilling platform 133. The drill string 108 thus extends from the rig floor 131, through the RCD 128, the annular BOP 125, the BOP stack 122, the riser 114, the wellhead 111, the wellbore casing, and along the borehole 104. Each of these structures or formations through which the drill string 108 extends respectively provides a passage through which the drill string 108 extends with radial clearance, forming an annular space (further referred to as "the annulus" and indicated by reference number 134) defined between a radially outer surface the drill string 108's drill pipe and a radially inner surface of the respective structures/formations.

Drilling fluid (e.g. drilling "mud," or other fluids that may be in the well, and also referred to as "drilling fluid") is circulated downhole via a hollow interior of the drill string 108, and uphole via the annulus 134. A pump system 137 delivers pressurized drilling fluid from a mud tank 140 on the drill rig 103 to a supply line 143 connected to the drill string 108's interior drilling fluid conduit at the drilling platform 133. Drilling fluid from the annulus 134 returns to the pump system 137 and/or to the mud tank 140 through a return line 142 that is in fluid flow connection with the annulus 134 via the RCD 128. The drilling fluid is forced along the drill pipe of the drill string 108 towards its downhole end, where the drilling fluid exits under high pressure through the drill bit 116. After exiting from the drill string 108, the drilling fluid occupies the annulus 134 and moves uphole along the annulus 134 due to continued delivery of drilling fluid to the drill string 108 by the pump system 137. Drilling fluid in the annulus 134 carries cuttings from the bottom of the borehole 104 to the RCD 128, where the returning drilling fluid is diverted via the return line 142. The annular BOP 125 and the BOP stack 122 provide protection against blowout via the annulus 134 because of sudden pressure increases which may occur in the borehole 104. If, for instance, pressurized geological formations are encountered during drilling operations, a sudden release of gas, for example, can result in potentially disastrous fluid pressure spikes in the annulus 134.

The outer diameter of the annulus 134 is defined in the borehole 104 by a substantially cylindrical borehole wall having a substantially circular cross-sectional outline that remains more or less constant along the length of the borehole 104. A passage 206 (FIG. 2) in the RCD 128 is likewise substantially circular cylindrical.

As used with reference to the drill string 108, borehole 104, RCD 128, and annulus 134, the "axis" or "longitudinal axis" of the passage 206 or annulus 134 (and therefore of the drill string 108 or part thereof) means the longitudinally extending centerline of the substantially cylindrical peripheral wall (variously provided by the RCD 128, the riser 114, the borehole 104, etc.) that defines a radially outer periphery of the annulus 134. Generally, "axial" and "longitudinal" thus means a direction along a line substantially parallel with the longitudinal axis of the annulus 134 at the relevant point thereof under discussion; "radial" means a direction substantially along a line that intersects the longitudinal axis and lies in a plane transverse to the longitudinal axis, so that at least a directional component thereof is perpendicular to the longitudinal axis; "tangential" means a direction substantially along a line that does not intersect the longitudinal axis and that lies in a plane substantially perpendicular to the longitudinal axis; and "circumferential" or "rotational" refers to a substantially arcuate or circular path described by rotation of a tangential vector about the longitudinal axis. "Rotation" and its derivatives mean not only continuous or repeated rotation through 360° or more, but also includes, if the context permits: angular, circumferential, or pivotal displacement through less than 360°. "Pivotal" movement, and its derivatives, means a noncontinuous angular displacement about a particular axis, usually through less than 360°.

As used herein, movement or relative location "forwards" or "downhole" (and related terms) means axial movement or relative axial location along the longitudinal axis towards the drill bit 116, away from the drilling platform 133. Conversely, "backwards," "rearwards," or "uphole" means movement or relative location axially along the longitudinal axis, away from the drill bit 116 and towards the drilling platform 133. Note that in FIGS. 2-6 and 8 of the drawings, the downhole direction extends from left to right. Further, as used herein, the adjectives "trailing" and "leading" refer to location relative to fluid flow to which the structure discussion is exposed, typically being in the downhole direction within the drill string 108 and being in the uphole direction in the annulus 134.

Figure 2:
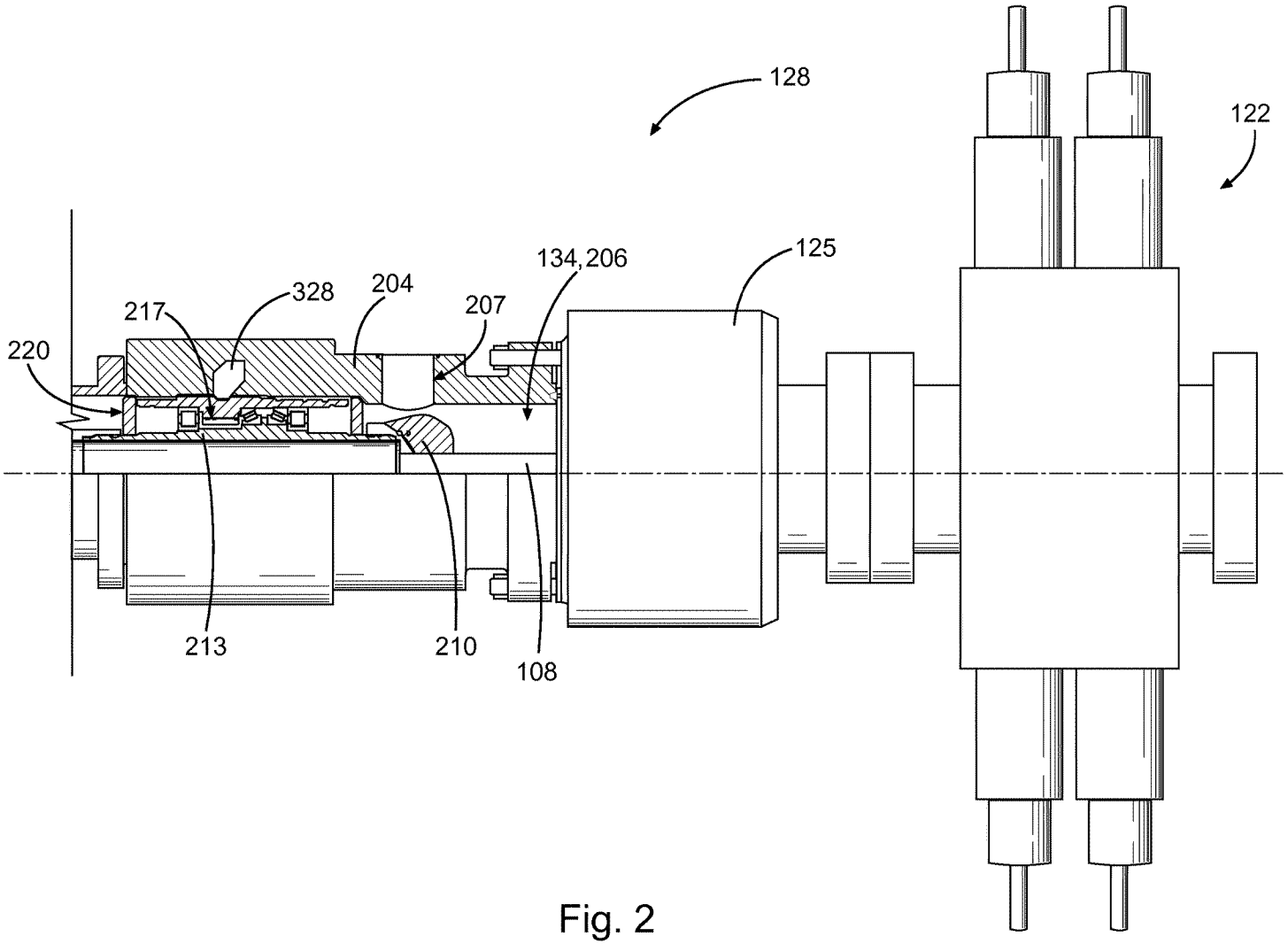
FIG. 2 depicts a partially sectioned side view of a portion of the example drilling system of FIG. 1 that includes the RCD in accordance with an example embodiment, the RCD being shown with an example annulus sealing assembly mounted in a passage provided by the body of the RCD.

Turning now to FIG. 2, it can be seen that the RCD 128 serves, in this example embodiment, both to divert annulus fluid to the return line 142, and to seal off the annulus 134 at its upper end. As will be described below in greater detail with reference to FIG. 2, the annulus 134 is sealed, in this example embodiment, by an insert assembly mounted in the passage 206 extending through a drill tool assembly provided by the RCD 128. The example insert assembly is an annulus sealing assembly 217 (FIG. 2) that includes a sealing element 210 comprising an elastomeric, generally annular member which sealingly engages an outer diameter of the drill string 108 (typically provided by the drill pipe), when the drill string 108 extends through the RCD 128 (see for example FIG. 2). The sealing element 210 is co-axially mounted in the RCD passage 206, the drill string 108 being journaled co-axially therethrough. In other embodiments, an annulus sealing assembly in the RCD 128 can include a plurality of sealing elements 210 (see, for example, FIG. 7). The drill string 108 is thus in axially sliding, circumferentially sealing engagement with the sealing element 210. When the drill string 108 is drivingly rotated, the sealing element 210 rotates with the drill string 108. To enable such operational rotation without excessive friction, the sealing element 210 is rotationally mounted in the RCD body 204 by a bearing assembly 220 that comprises a subassembly of the annulus sealing assembly 217, as will be described at greater length with reference to FIG. 3.

Figure 3:
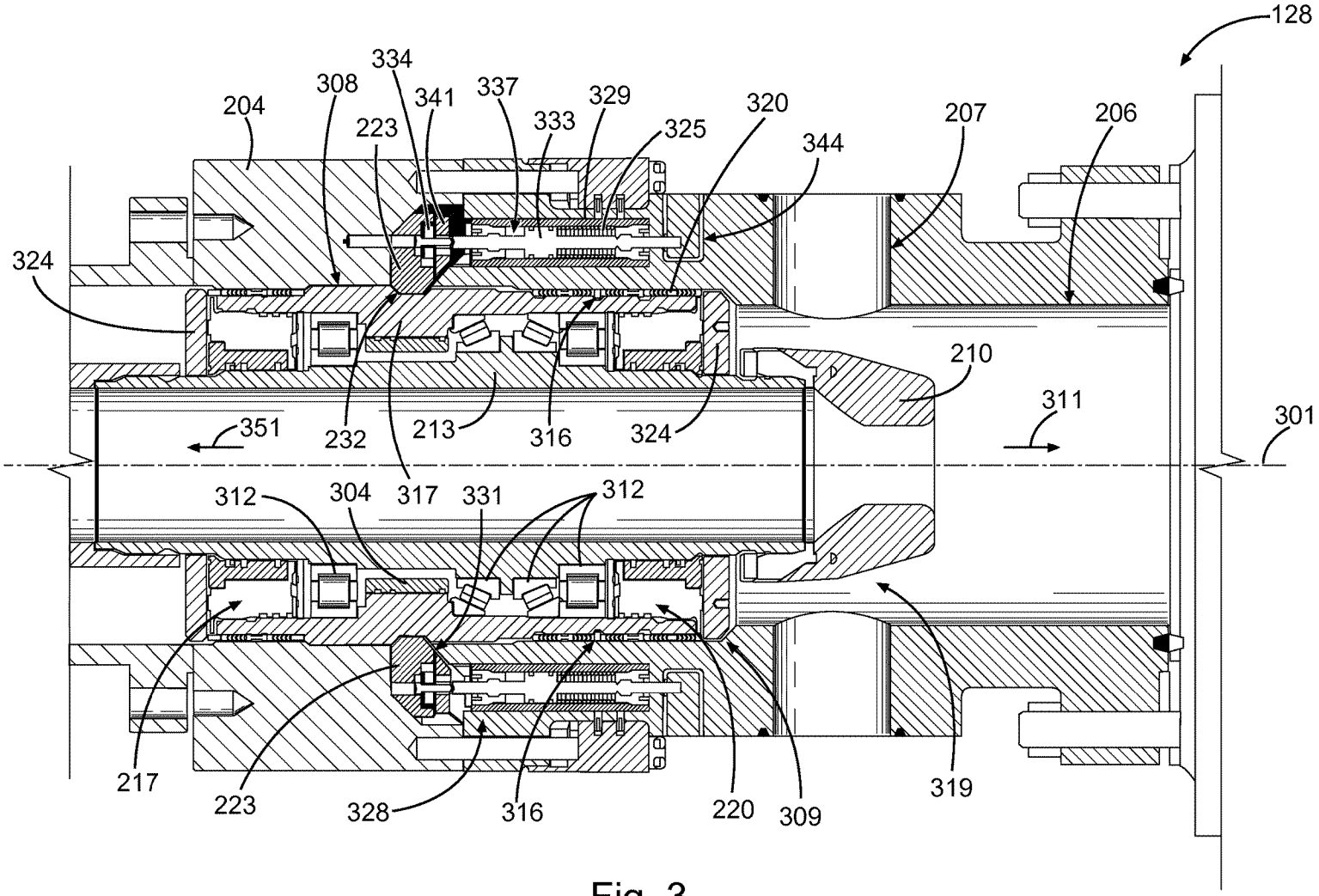
FIG. 3 depicts, to an enlarged scale, an axial section of an RCD body and an annulus sealing assembly mounted in the RCD body, in accordance with an example embodiment, the annulus sealing assembly being in a latched, operational condition.

FIG. 3 shows a more detailed view of the RCD 128 and the annulus sealing assembly 217 in accordance with a particular example embodiment. As mentioned, the passage 206 that extends through the RCD body 204 has a circular cylindrical peripheral wall that defines the outer diameter for the annulus 134. Note that, for clarity of illustration, the views of FIGS. 3, 4, 6, and 8 omit the drill string 108, which will in practice extend co-axially through the circular opening of the sealing element 210. The body 204 further defines a pair of return ports 207 branching laterally from the annulus passage 206 at a position downhole of the annulus sealing assembly 217. In some examples, only a single return port 207 is provided. As can also be seen in FIG. 2, a downhole end of the RCD 128 is bolted to the annular BOP 125 via a connection flange.

The annulus sealing assembly 217 is located in a complementary housing socket 308 defined therefor by the RCD body 204, the housing socket 308 in this example embodiment comprising a widened portion of the passage 206 at an uphole end of the RCD 128. The housing socket 308 forming an annular shoulder 309 that acts as a no-go against which the annulus sealing assembly 217 stops when it is inserted axially into the passage 206 in a downhole direction (indicated by arrow 311 in FIG. 3). The shoulder 309 anchors the annulus sealing assembly 217 against axial displacement downhole beyond its dedicated location in the housing socket 308.

The annulus sealing assembly 217 in this example embodiment comprises the bearing assembly 220 and a rotary portion 319 that is rotationally mounted in the RCD 128 by the bearing assembly 220. As can be seen in FIG. 3, the rotary portion 319 comprises a substantially tubular mandrel 213 defining a central channel that is co-axial with a longitudinal axis 301 of the passage 206 through the RCD 128. The mandrel 213 is dimensioned to slidingly guide the drill string 108 co-axially therethrough, so that the mandrel 213, in operation, fits sleeve-fashion around the drill string 108.

The rotary portion 319 further comprises the sealing element 210 mounted on a downhole end of the mandrel 213, with a central orifice of the sealing element 210 being co-axial with the mandrel 213 and the annulus passage 206. As previously mentioned, the sealing element 210 comprises an elastomeric generally doughnut-shaped or toroidal sealing portion that defines a sealing orifice through which the drill string 108 in use extends. As illustrated in FIG. 3 (in which no drill string is received through the mandrel 213 and sealing element 210, so that the sealing element 210 is in an unstressed state), the sealing orifice of the sealing element 210 is smaller than the outer diameter of the drill string 108 (which is only slightly smaller than the inner diameter of the mandrel 213's channel), to promote circumferential sealing of the sealing element 210 around the drill string 108 because of resilient dilation of the sealing orifice when the drill string 108 is passed through the annulus sealing assembly 217. Resulting friction between the sealing element 210 and the drill string 108 causes the sealing element 210 to rotate with the drill string 108 when the drill string 108 is rotated during drilling operations. The sealing element 210 is rotationally and longitudinally keyed to the mandrel 213, so that the mandrel 213 is configured for rotation with the sealing element 210.

The mandrel 213 is rotationally mounted in the RCD body 204 by the bearing assembly 220. The bearing assembly 220 in this example embodiment comprises a bearing housing 317 that is broadly tubular in shape and is dimensioned for complementary co-axial reception in the housing socket 308 with sliding clearance, in some cases being a press-fit in the housing socket 308. The bearing housing 317 is mounted in the RCD body 204 such that it is rotationally stationary, in operation. The mandrel 213 is radially spaced from the bearing housing 317 by a set of roller bearings 312 that are mounted in the bearing housing 317 and in which the mandrel 213 is journaled. In this example embodiment, the set of bearings 312 comprise a subset of radial bearings and a subset of axial thrust bearings. Each roller bearing 312 has a stator or outer race which is statically connected to the bearing housing 317, and a rotor or inner race which is connected to the mandrel 213 for rotating therewith.

Figure 5:
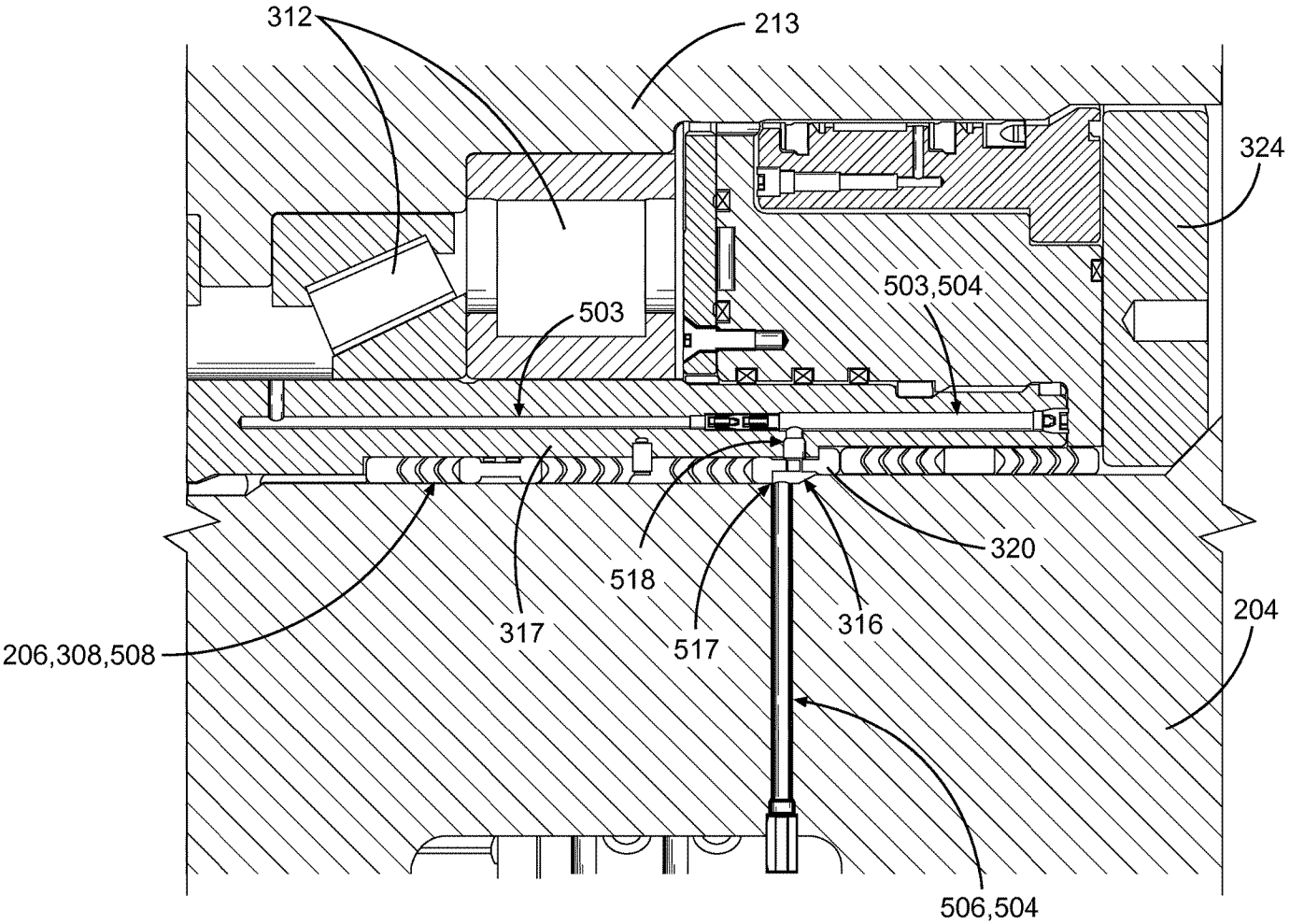
FIG. 5 depicts an enlarged detail view, in axial section, of an interface between a radially outer portion of the bearing assembly and the RCD body, at which an annular removal volume is defined, in accordance with an example embodiment

Opposite ends of the bearing housing 317 are closed off by respective end caps 324, so that the bearing assembly 220 has a substantially sealed hollow interior that extends circumferentially around the mandrel 213, and in which the bearings 312 are located. Turning briefly to FIG. 5, it can be seen that the bearing housing 317 includes a network of lubrication passages 503 forming part of a lubrication fluid circuit 504 to channel a lubrication fluid, typically lubrication oil, into the hollow interior of the bearing assembly 220, and to the bearings 312. Another part of the lubrication fluid circuit 504 is provided by a number of lubrication supply channels 506 (only one of which is shown in FIG. 5) defined by the RCD body 204 to convey lubrication oil through the body 204 and into the lubrication passages 503 of the bearing housing 317.

A radially outer surface of the bearing housing 317, and a generally circular cylindrical peripheral wall 508 of the housing socket 308 provided by the body 204 are shaped and dimensioned to define between them a removal volume 316. The removal volume 316 therefor extends radially between the generally cylindrical, radially outer surface of the bearing housing 317, and the generally cylindrical radially inner surface of the passage wall 508 of the body 204. The removal volume 316 further extends axially along a portion of the length of the bearing housing 317. In this example embodiment, the removal volume 316 extends circumferentially around the bearing housing 317, thus being broadly annular in shape. In other embodiments, the removal volume 316 may not extend continuously around the bearing assembly 220, but may, for example, comprise a series of circumferentially staggered chambers. The removal volume 316 is shaped to cause the exertion of a net fluid pressure force on the bearing housing 317 in a removal direction (schematically indicated by arrow 351 in FIG. 3), in response to pressurization of fluid in the removal volume 316. As will described below, the lubrication supply channels 506 provide a fluid supply mechanism to deliver pressurized fluid to the removal volume 316.

In the embodiment illustrated in FIG. 5, the substantially tubular removal volume 316 tapers stepwise in the downhole direction, so that the outer diameter of the bearing housing 317 progressively decreases towards its downhole end. As a result, a cross-sectional area of the bearing housing 317 which is exposed to axially uphole urging by pressurized fluid in the removal volume 316 is greater than the cross-section area of the bearing housing 317 that is exposed to axially downhole urging by fluid in the removal volume 316. This differential area results in a net fluid pressure bias or resultant fluid pressure force acting axially uphole, which in this instance is the removal direction 350 for the bearing assembly 220. Note that the removal volume 316 does not necessarily have to be shaped but that many variations in the shapes of the bearing housing 317 and the RCD body 204 are possible to provide a removal volume which produces a bias in the removal direction in response to fluid to the removal volume 316.

Furthermore, at least part of a periphery of the removal volume 316 may be provided by one or more sealing members in the removal volume 316. A static seal set 320 is, for instance, located in the removal volume 316 of the example embodiment of FIG. 5, to provide sealing engagement between the bearing assembly 220 and the RCD body 204. In some embodiments, the static seal set 320 may be configured to permit occupation of substantially all of the removal volume 316 by a removal fluid such as a hydraulic medium (in this example, lubrication oil) or a pneumatic medium (e.g., pressurized nitrogen gas), while substantially preventing inflow or migration of drilling fluid axially uphole into the removal volume 316. In other embodiments, the static seal set 320 may be configured to limit pressurized hydraulic or pneumatic fluid in the removal volume 316 to only a part of the removal volume 316, so that the net fluid pressure bias is exerted on the bearing housing 317, at least in part, indirectly, via the static seal set 320.

Referring again to FIG. 5, it will be seen that the lubrication passage 503 of the bearing housing 317 is in communication with the lubrication supply channel 506 of the RCD body 204 via the removal volume 316, with the lubrication supply channel 506 of the RCD body 204 having an outlet port 517 in the removal volume 316, while the lubrication passage 503 has a radial inlet port 518 in the removal volume 316. In this example embodiment, the outlet port 517 of the lubrication supply channel 506 and the inlet port 518 of the lubrication passage 503 are adjacent one another, being in close radial and axial proximity. Returning now to FIGS. 2 and 3, it is shown that the RCD 128 further comprises a latch mechanism 328 to provide selective axial anchoring of the bearing assembly 220 to the RCD body 204. In this example, the latch mechanism 328 comprises a series of latch formations in the form of a series of latch dogs 223 that are mounted in the RCD body 204 and are configured for radial displacement between, on one hand, a latched condition in which each dog 223 is received in a complementary latch formation in the form of a recess 232 in the radially outer surface of the bearing housing 317, and, on the other hand, an unlatched condition in which the dogs 223 are clear of the passage 206, to permit axial movement of the bearing assembly 220 in the removal direction 351 without obstruction of the bearing housing 317 on the dogs 223. In this example embodiment, the RCD 128 includes a circumferentially extending, regularly spaced series of eight dogs 223.

Movement of the dogs 223 from the latched position to the unlatched position therefor comprises radially outward movement of the dogs 223. The latch mechanism 328, however, includes a bias arrangement that biases the dogs 223 to the latched condition. In this embodiment, the latching bias is a spring bias provided by a helical compression spring 325 that is housed in a latch cylinder 329 and acts on a respective latch piston 333 for each dog 223, to urge the latch piston 333 into a position corresponding to the latched position of the associated dog 223. Referring again to FIG. 3, it can be seen that the latch piston 333, in this example embodiment, is mounted for axial sliding movement in the removal direction 351 (against the spring bias) in response to pressurization of a pressure chamber 337 defined by the cylinder 329. The spring-loaded latch piston 333 is urged in the uphole direction by the spring bias, pushing the dog 223 connected to the latch piston 333 down a ramp formation 331 and into engagement with the corresponding recess 232. A pin at a distal end of the to the piston 333 extends through a slotted plate 341 connected to the dog 223, the slotted plate 341 being held captive between the latch piston 333 and a shoe 334 attached to the latch piston 333, so that the slotted plate 341 is radially slidable on the piston 333.

Figure 4:
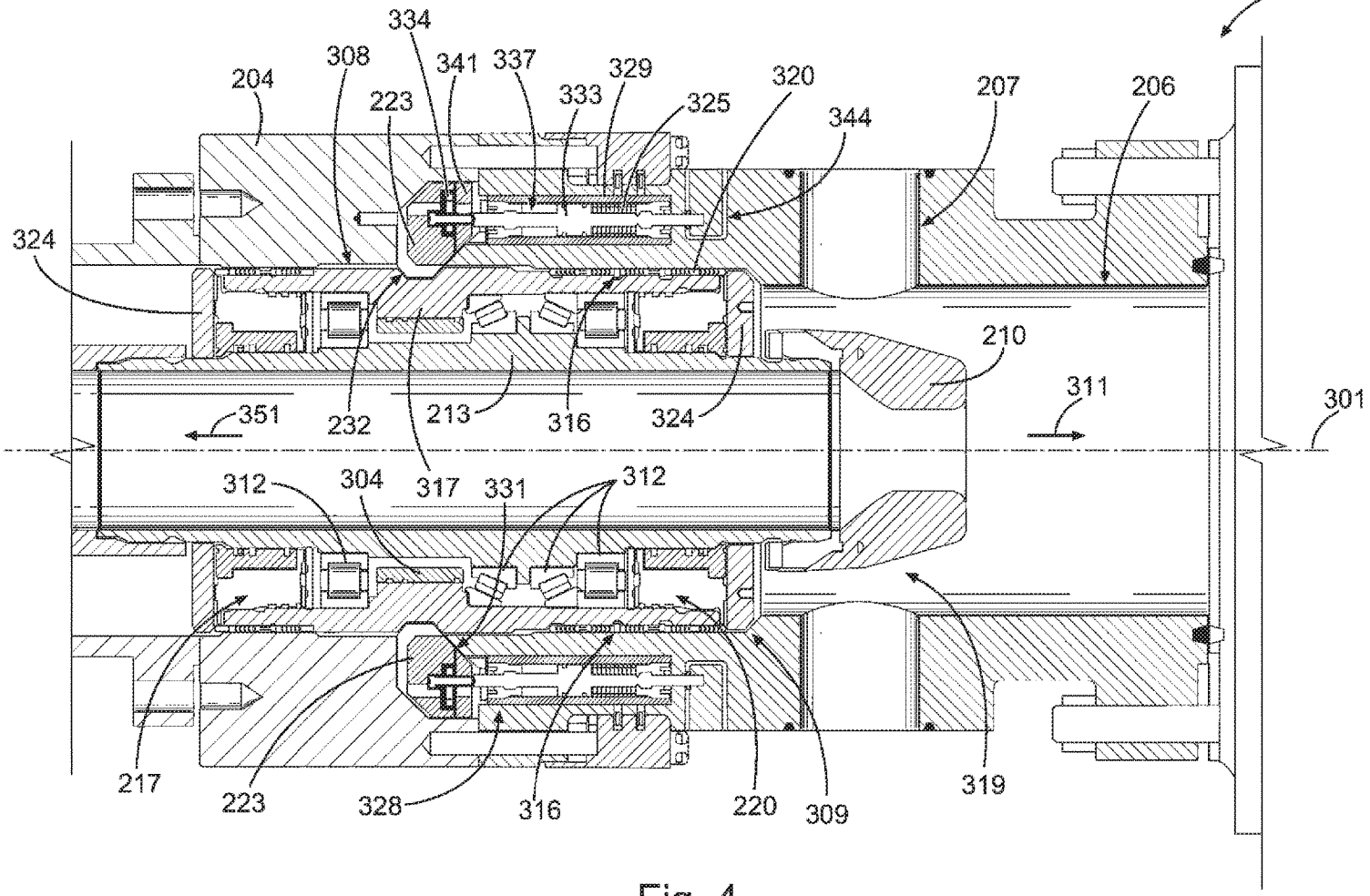
FIG. 4 depicts a view corresponding to that of FIG. 3, the annulus sealing assembly being in an unlatched condition.
Figure 6:
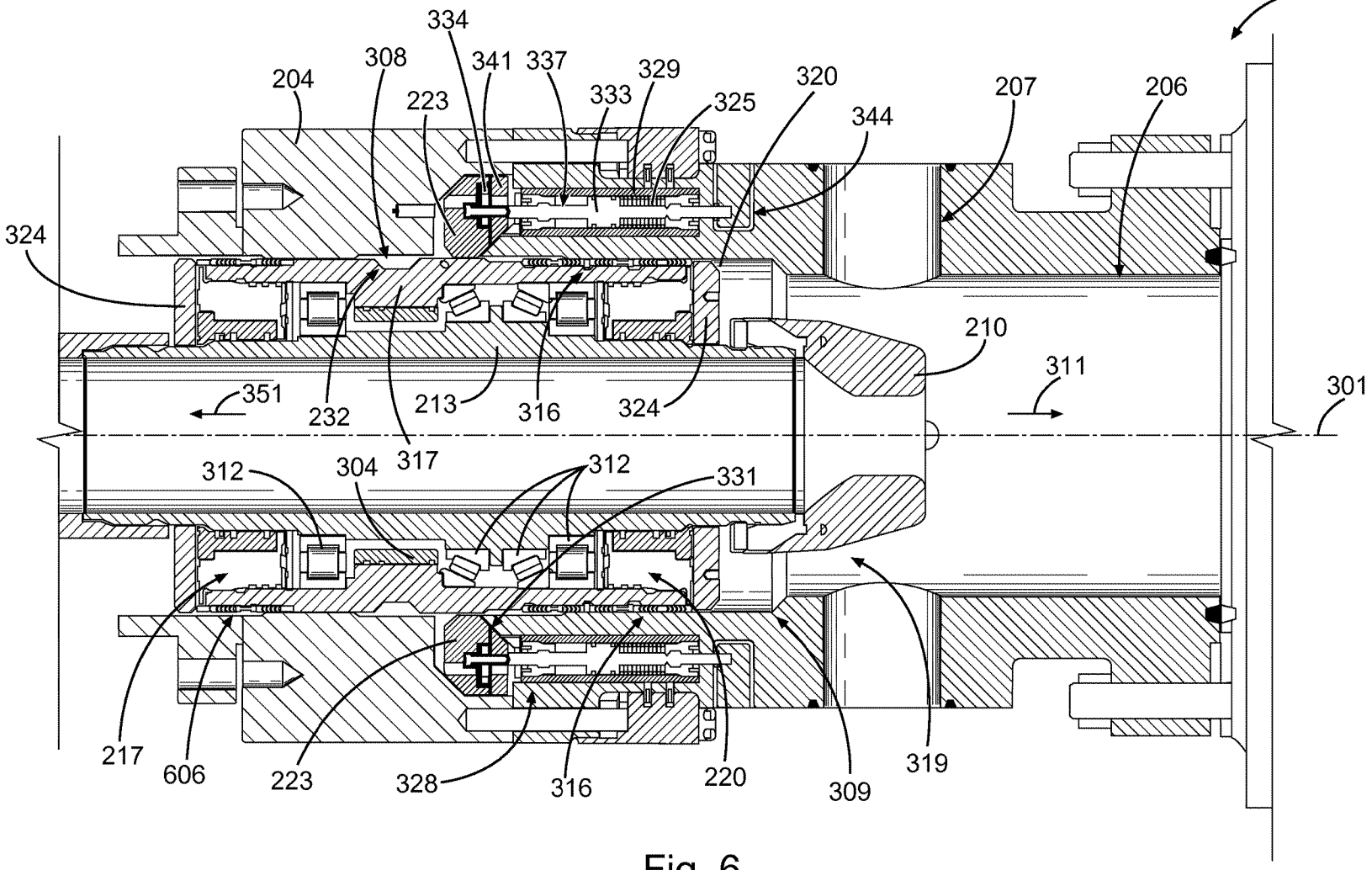
FIG. 6 depicts a view corresponding to that of FIG. 5, with the example annulus sealing assembly being in the unlatched condition and having been axially displaced in a removal direction from the position shown in FIGS. 4 and 5.

Hydraulically actuated retraction of the latch piston 333, against its spring bias, thus pulls the associated dog 223 up the ramp formation 331 to move the dog 223 radially clear of the recess 232 and the passage 206 (FIGS. 4 and 6). In this example, a latch control fluid circuit 344 for selectively controlling hydraulically actuated switching of the latch mechanism 328 between the latched and unlatched conditions is separate from the removal fluid circuit to deliver pressurized hydraulic/pneumatic fluid to the removal volume 316 (the removal fluid circuit in this example embodiment being provided by the lubrication fluid circuit 504 which also delivers lubrication oil to the bearing assembly 220). The respective circuits controlling the latch mechanism 328 and pressurization of the removal volume 316, respectively, may be coupled to a common hydraulic control system 700 which may be configured to permit or effect pressurization of the removal volume 316 only when the latch mechanism 328 is unlatched.

Figure 7:
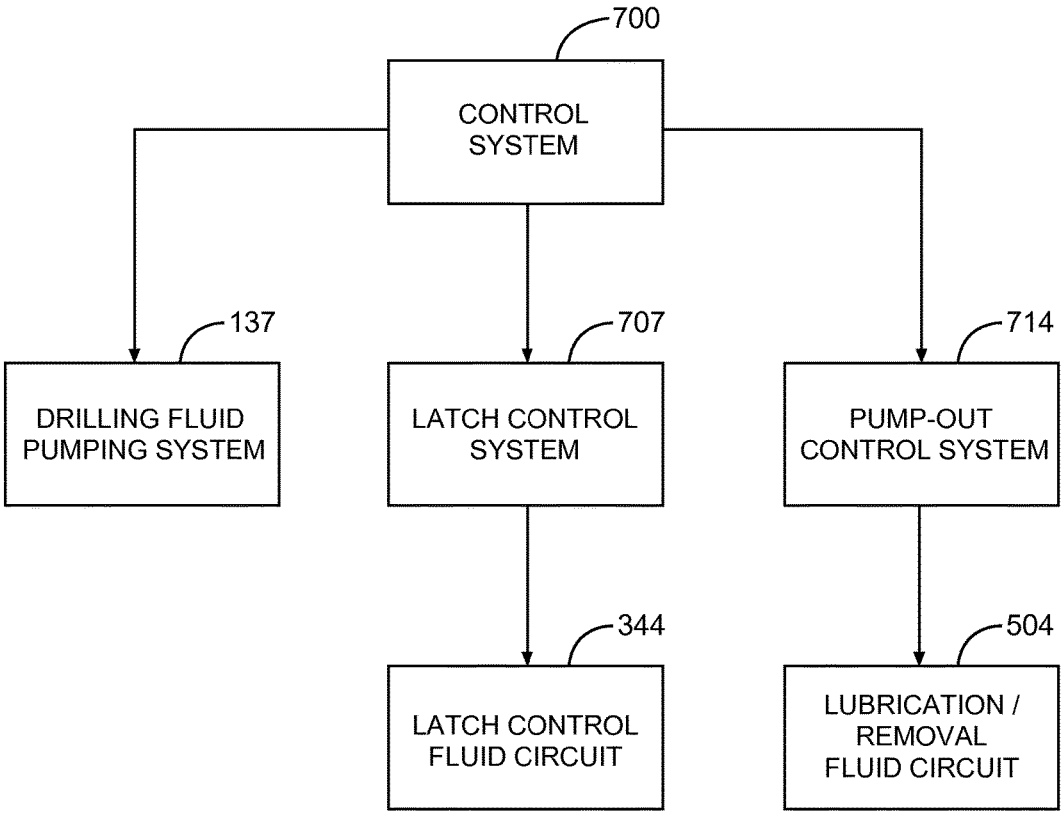
FIG. 7 depicts a schematic diagram of a hydraulic control system forming part of the drilling system of FIG. 1, in accordance with an example embodiment.

An example embodiment of the hydraulic control system 700 is schematically illustrated in FIG. 7, in this example providing consolidated control of the various hydraulic or fluid circuits that are used during drilling operations. The hydraulic control system 700 may thus include the drilling fluid pump system 137 that controls pressurized delivery of drilling fluid to the drill string 108. The hydraulic control system 700 may further comprise a latch control system 707 configured and arranged for controlling the latch mechanism 328 by controlling fluid pressure in the latch control fluid circuit 344, and thereby to control latching and/or unlatching of the latch dogs 223 by controlling an axial position of the latch pistons 333 in the cylinders 329. The hydraulic control system 700 may further comprise a pump-out control system 714 to control delivery and pressurization of the hydraulic removal fluid to the removal volume 316.

As described above, the removal fluid, in this example embodiment, is in the form of lubrication oil used for operational lubrication of the bearing assembly 220, so that the lubrication fluid circuit 504 doubles as a removal fluid circuit. The pump-out control system 714 therefore, in this example embodiment, controls delivery and pressurization of lubrication oil to the dual-purpose lubrication/removal fluid circuit 504. The pump-out control system 714 is configured to pressurize hydraulic oil in the lubrication fluid circuit 504 during normal operation such that the fluid pressure is appropriate for lubrication of the interior of the bearing assembly 220 to facilitate rotation of the rotary portion 319 relative to the bearing housing 317. The pump-out control system 714 is, however, further configured to pressurize the lubrication oil to significantly greater pressure levels when removal of the bearing assembly 220 is required, thus to provide a net fluid pressure bias on the removal volume 316 in the removal direction 351. Pressurization of the removal volume 316 is such as to provide a net fluid pressure bias that is sufficiently large to dislodge the bearing assembly 220, or to provide nontrivial assistance for removal of the bearing assembly 220 in the removal direction 351. In this example embodiment, the lubrication oil (serving also as removal fluid) is maintained at in a pressure range of 200 to 2000 psi during normal drilling operations, but is raised to a pressure range of 500 to 5000 psi when the annulus sealing assembly 217 is to be removed. Note that, in other embodiments, the removal fluid and the removal fluid circuit may be separate from each other, with different fluids serving as lubrication fluid and removal fluid respectively. In such cases, the pumpout control system 714 may be separate from a lubrication fluid control system. In yet further embodiments, the lubrication circuit may be omitted, so that the RCD body 204 provides only a removal fluid supply mechanism to the removal volume 316.

The hydraulic control system 700 can be configured for automated sequencing of insert assembly unlatching and removal. The hydraulic control system 700 can thus be configured automatically to perform elevated pressurization of the removal/lubrication fluid circuit 504 only after the annulus sealing assembly 217 has been unlatched via the latch control system 707. In other embodiments, sequencing of the unlatching and removal volume pressurization steps can be performed manually by a human operator.

In operation, the drill string 108 is passed through the mandrel 213 and through the sealing element 210, to permit both rotation and axial sliding of the drill string 108 relative to the RCD 128, while the annulus 134 is sealed off at its uphole end by the annulus sealing assembly 217. As mentioned previously, the sealing element 210 seals the inner diameter of the annulus by its engagement with the radially outer surface of the drill string 108. The bearing assembly 220 occupies the annulus 134 in the housing socket 308, the bearing housing 317 sealing the outer diameter of the annulus 134 by operation of the static seal set 320. During normal drilling operations, the annulus 134 below the annulus sealing assembly 217 is filled with drilling fluid at wellbore pressure, so that there is a substantial pressure difference over the annulus sealing assembly 217. The annulus sealing assembly 217 is, however, axially locked in position by operation of the latch mechanism 328, which remains latched whenever the annulus immediately downhole of the annulus sealing assembly 217 is pressurized, e.g., being at wellbore pressure.

When the sealing element 210 and/or the bearings 312 are to be replaced, either because of excessive wear of these components, or in a preventative maintenance operation, circulation of the drilling fluid is temporarily halted, so that the annulus 134 below the annulus sealing assembly 217 is not pressurized by the pump system 137. The drill string 108 may thereafter be removed by retraction of the drill string 108 in the removal direction 351, axially through the mandrel 213. The RCD 128 and the annulus sealing assembly 217 are then in the condition shown in FIG. 3. In other instances, removal of the annulus sealing assembly 217 may be performed without prior extraction of the drill string 108. In such cases, axial friction between the sealing element 210 and the drill string 108 may be employed in removal of the annulus sealing assembly 217, so that the drill string 108 is used as a pulling tool to pull the annulus sealing assembly 217 from the housing socket 308 while the latch mechanism 328 is unlatched and a net fluid pressure bias is exerted on the bearing assembly 220 via the removal volume 316, as discussed below.

Returning now to description of the RCD 128 in the condition shown in FIG. 3, with the drill string 108 removed, the bearing assembly 220 is unlatched by hydraulically actuated radially outward displacement of the latching dogs 223 to their unlatched, retracted positions. This is achieved by delivering hydraulic control fluid under pressure to the pressure chambers 337 of the latch cylinders 329. Resultant expansion of the pressure chambers 337 pushes the respective latch pistons 333 downhole against the urging of the respective compression springs 325, thus pulling the latch dogs 223 up the ramp formations 331 and clear of the bearing housing 317's outer diameter. The annulus sealing assembly 217 is now unlatched, and there is no positive engagement between any component of the RCD body 204 and the bearing assembly 220 that restricts axial displacement of the bearing assembly 220 in the removal direction 351. Axial displacement of the bearing assembly 220, and therefore of the annulus sealing assembly 217, in the downhole direction 311 is prevented by the shoulder 309 at the bottom end of the housing socket 308.

In the absence of any accumulated material that obstructs axial movement of the bearing assembly, the unlatched bearing assembly 220 can be extracted from the RCD body 204 with the drill string 108 passed through the mandrel 213 and sealing element 210 (should that be the case), due to friction between the sealing element 210 and the drill string 108, or with a pulling tool that can be engaged with the rotary portion 319 of the annulus sealing assembly 217. In practice, however, material often accumulates between the peripheral wall 508 of the housing socket 308 provided by the RCD body 204 and the bearing assembly 220, because of drilling fluid and cuttings flowing through the passage 206 and migrating to positions between the bearing assembly 220 and the RCD body 204. Because of such accumulation, the bearing assembly 220 can become stuck in the RCD body 204 to such extent that removal of the annulus sealing assembly 217 with a pulling tool or with the drill string 108 becomes problematic.

In such instances, the hydraulic control system 700 can be operated to pressurize the lubrication/removal fluid circuit 504, so that hydraulic fluid (in this example lubrication oil) in the removal volume 316 is pressurized at an elevated level. As discussed above, the removal volume 316 has a differential pressure area resulting in a net fluid pressure bias exerted on the bearing assembly 220 in the removal direction 351 (uphole). In this example, the removal volume is occupied by the static seal set 320, so that the net fluid pressure bias is exerted on the bearing assembly 220 via the static seal set 320, pushing or urging the bearing assembly 220 in the removal direction 351 through hydraulic action.

Pressurization of the removal volume 316 may comprise pressurizing the lubrication oil to a predetermined removal pressure. In other embodiments, however, fluid pressure in the removal volume 316 may be increased gradually or progressively, thereby gradually increasing the net fluid pressure bias in the removal direction 351, until the bearing assembly 220 is dislodged or jacked out of its operatively mounted position in which the lowermost end abuts against the shoulder 309. Such dislodgement, or loosening, of the annulus sealing assembly 217 may be effected by operation of the pressurized removal volume 316 only, or, in other instances, may comprise application of the net fluid pressure bias exerted via the removal volume 316 synchronously with a pulling force exerted on the annulus sealing assembly 217 (via the rotary portion 319) by the drill string 108 or a specialized pulling tool. The annulus sealing assembly 217 (or, in some instances, only the bearing assembly 220) can thus effectively be pumped out of its mounted position in the annulus 134, allowing hydraulically actuated removal of a stuck bearing assembly 220.

Figure 9:
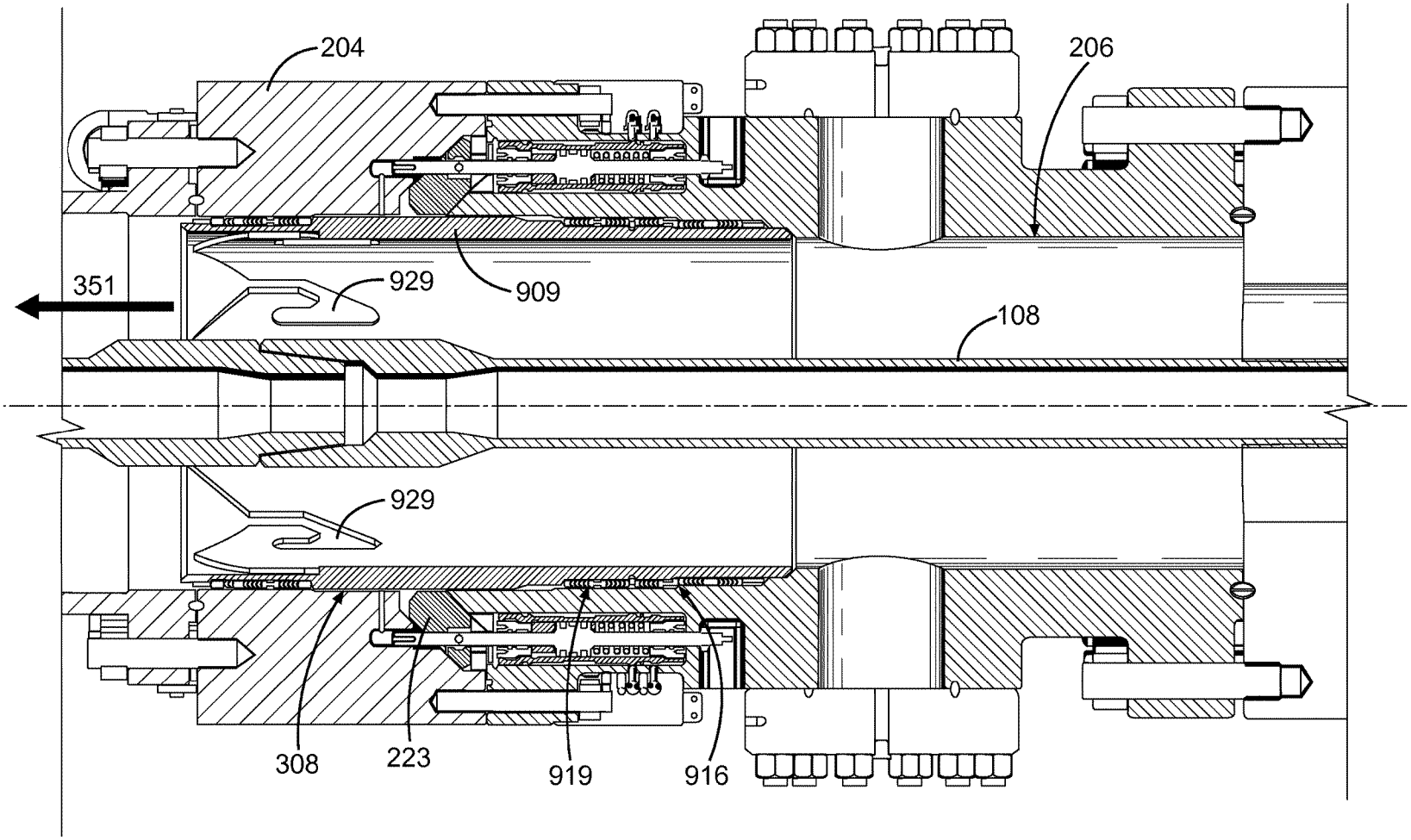
FIG. 9 depicts an axial section of an RCD which has mounted therein a drill tool insert in the form of a bore protector, according to an example embodiment.

After removal of the annulus sealing assembly 217 a bore protector 909 can in some cases be inserted in the RCD body 204, as illustrated in FIG. 9, to serve as a temporary protective liner for the peripheral wall 508 of the housing socket 308. The bore protector 909 thus protects the peripheral wall 508 from damage by fluid flowing through the passage 206. Mechanisms and operations for mounting and removing the bore protector 909 may be similar or analogous to that described above with reference to the annulus sealing assembly 217. In particular, removal of the bore protector 909 may be at least partially through hydraulic actuation of the bore protector 909 by use of the same pumpout control system 714 and lubrication/removal fluid circuit 504 that are used for removal of the annulus sealing assembly 217, as described above.

In this example embodiment, the bore protector 909 has a generally tubular body that has a radially outer cylindrical surface 919 shaped for complementary cooperation with the peripheral wall 508 of the passage 206 and to define between them a removal volume 916 which is configured such that a net fluid pressure bias is exerted on the bore protector 909 in the removal direction 351, when the removal volume 916 is pressurized. The bore protector 909 may, in particular, be shaped such that the removal volume 916 is defined substantially in the same axial position as is the case for the removal volume 316 previously defined between the annulus sealing assembly 217 and the passage wall 508. In this example embodiment, the outer surface 919 of the bore protector 909 is a substantially identical to the corresponding outer surface of the bearing housing 317 described earlier. As a result, the removal volume 916 of the bore protector 909 is in this example substantially identical to the annulus sealing assembly 217's removal volume 316 in size, shape, and axial position. The outlet ports 517 of the lubrication supply channels 506 thus open into the removal volume 916 of the bore protector 909, placing the lubrication supply channels 506 in fluid communication with the removal volume 916. Note that the example bore protector 909 does not define a recess corresponding to the bearing housing recess 232 (FIG. 3), and is therefore not engaged for axial anchoring by the latch mechanism 328.

When a reconditioned or replacement annulus sealing assembly 217 is again to be mounted in the RCD body 204, the bore protector 909 can be removed in a manner similar to that described previously for removal of the annulus sealing assembly 217. The pumpout control system 714 may thus increase pressure of the hydraulic medium in the lubrication fluid circuit 504, pressurizing the removal volume 916 and causing a net removal force to be exerted on the bore protector 909 in the removal direction 351. The bore protector 909 can be grabbed and pulled with a pulling tool (not shown) that engages hook formations 929 provided for this purpose at an uphole end of the bore protector 909. In some cases, bore protector 909 may first be loosened or made unstuck by hydraulic action via the removal volume 916, only there after being extracted by use of the pulling tool. In other instances, the pulling tool and the hydraulic removal mechanisms may be used concurrently to exert a greater resultant extraction force on the bore protector 909.

It is a benefit of the example method and drill tool assembly described above that it facilitates removal of the annulus sealing assembly 217, including the bearing assembly 220, thus reducing time and frustration typically associated with such maintenance operations. Because the removal volume 316 is radially located at a position that is substantially coincident with the interface between the bearing assembly 220 and the RCD body 204, an axial removal force generated by pressurized fluid in the removal volume 316 is particularly effective for removal of a stuck bearing assembly 220. This is in part because there is substantially no moment arm between the hydraulic removal force and resistive forces acting axially against removal of the bearing assembly 220. Furthermore, in instances where the removal volume 316 is symmetrical about the longitudinal axis 301, removal forces acting on the bearing assembly 220 are similarly symmetrical, because of a common universal pressure in the removal volume 316. In contrast, a pulling tool acting on the sealing element 210 acts at an annular interface located radially inside of the bearing assembly/RCD body interface, so that axial removal forces are misaligned with axial resistive forces exerted by the RCD body 204 on the bearing assembly 220. Forces exerted by such a pulling tool are often asymmetrical, thus tending to cause asymmetrical resistive forces and/or a net resultant torque on the bearing assembly 220, frustrating ready removal of the bearing assembly 220.

Figure 8:
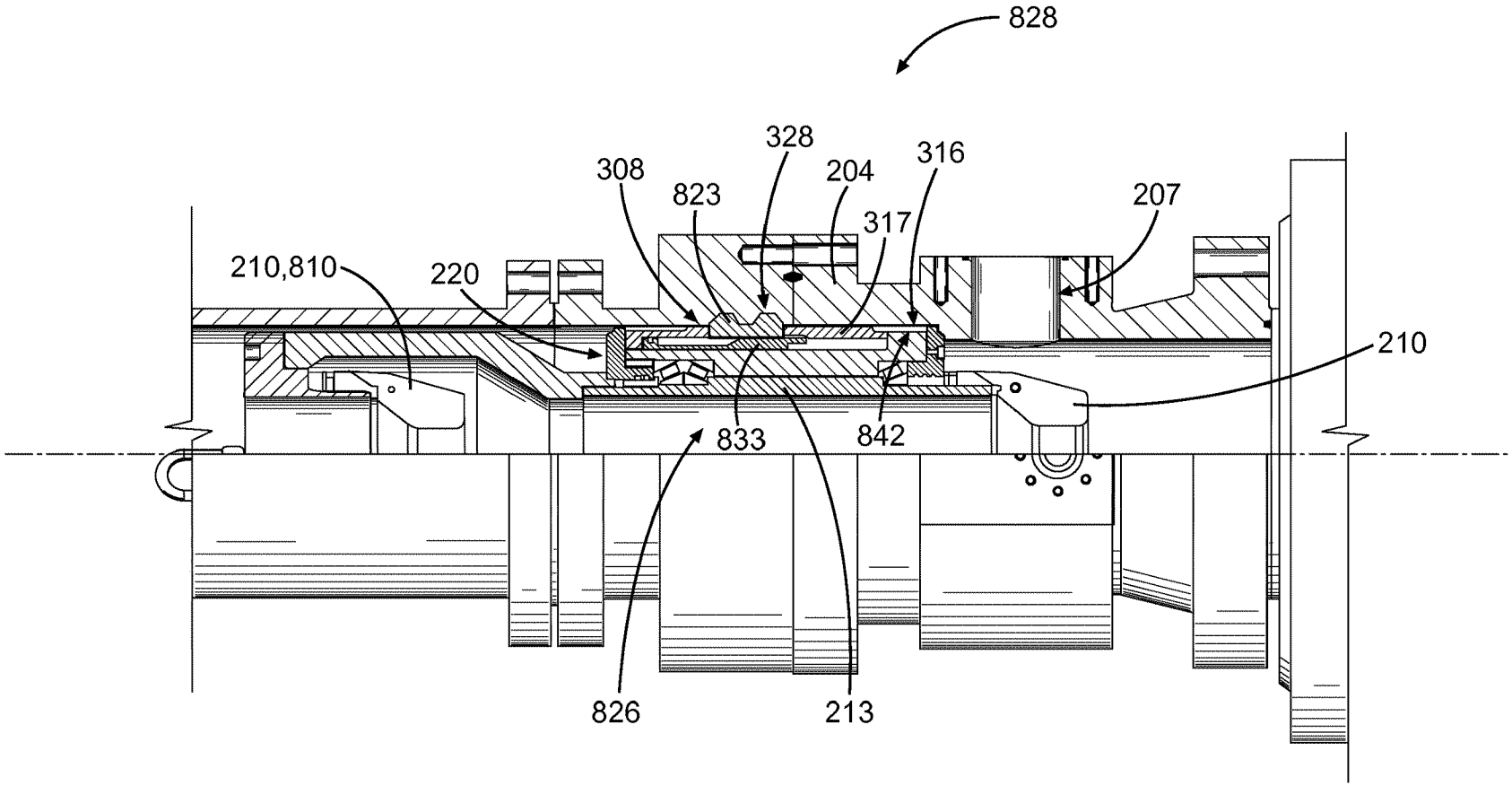
FIG. 8 depicts a partially sectioned side view of an RCD in accordance with another example embodiment.

FIG. 8 illustrates another example RCD 828 fitted with a annulus sealing assembly 826, in accordance with a further example embodiment. The RCD 828 of FIG. 8 has a stackable style body 204 and includes an upper stripper 810 that provides an additional sealing element 210, when compared to the above-described FIG. 3 example embodiment. The RCD 828 has a latch mechanism 328 comprising latching dogs 823 that are mounted on the bearing assembly 220 and configured for radial outward displacement into engagement with complementary recesses in the RCD body 204. An annular latch piston 833 is slidingly received within the bearing housing 317, being axially displaceable by hydraulic action to lock the latching dogs 823 in a latched position by abutment of a radially outer surface of the latch piston 833 against opposed radially inner surfaces of the respective latching dogs 823. When the latch piston 833 is disposed to the extreme downhole position, radially inward movement of the latching dogs 823 is permitted in response to axial displacement of the bearing assembly 220 in the removal direction, through operation of complementary inclined surfaces on the latching dogs 823 and the RCD body 204.

In the example embodiment of FIG. 8, the removal volume 316 is defined in part by an annular recess 842 in the radially outer surface of the bearing housing 317, with the housing socket 308 of the RCD body 204 having a constant diameter along its length. Although not shown in FIG. 8, the RCD body 204 defines removal fluid supply passages leading into the removal volume 316, to deliver pressurized removal fluid to the removal volume 316. Pressurization of the removal volume 316 thus again exerts a net axial fluid pressure force on the annulus sealing assembly 217 via the bearing housing 317, to facilitate or effect dislodgement and subsequent extraction of the annulus sealing assembly 826.

One aspect of the above-described embodiment therefore provides a method for removing a tool insert from a passage in a drill tool body, the method comprising: displacing the tool insert in a removal direction relative to the drill tool body by pressurizing a fluid in a removal volume defined between the drill tool body and the tool insert, to exert a net fluid pressure bias on the insert in the removal direction.

The tool insert may comprise an insert assembly, in some embodiments comprising an annulus sealing assembly. In other embodiments, the insert assembly may be a bore protector that is mounted in the drill tool body when the annulus sealing assembly has been removed, to protect a radially inner wall of the passage from damage or wear in the absence of the annulus sealing assembly. In other embodiments, the disclosed method can be used to free other accessories that become stuck in a drill tool body or elsewhere in the annulus.

The insert assembly may comprise a rotary portion configured for operational rotation in the passage relative to the drill tool body; and a bearing assembly that rotationally supports the rotary portion in the passage, the removal volume being located between the bearing assembly and the drill tool body such that the net fluid pressure bias acts on the bearing assembly. a bearing housing that is mounted in the passage to be rotationally stationary relative to the drill tool body, the removal volume being defined between the bearing housing and a drill tool body, so that the net fluid pressure bias acts on the bearing housing; and one or more bearings mounted in the bearing housing and rotationally supporting the rotary portion in the bearing housing. In such cases, the bearing assembly may comprise a bearing housing that is mounted in the passage to be rotationally stationary relative to the drill tool body, the removal volume being defined between the bearing housing and a drill tool body, so that the net fluid pressure bias acts on the bearing housing; and one or more bearings mounted in the bearing housing and rotationally supporting the rotary portion in the bearing housing. The bearing housing may be substantially tubular and may be mounted co-axially in the passage. The removal volume may thus comprise a substantially annular space extending radially between a radially outer surface of the bearing housing and a peripheral wall of the passage provided by the drill tool body.

The method may further comprise unlatching a latch mechanism that axially anchors the insert assembly to the drill tool body, the unlatching of latch mechanism permitting axial removal of the insert assembly from the passage under axial urging of at least the net fluid pressure bias. Unlatching of the latch mechanism may comprise hydraulically actuated radially outward displacement of a plurality of latch formations, e.g. latching dogs, mounted on the drill tool body and projecting radially inwards into latching engagement with a plurality of complementary latch formations, e.g. latch recesses, forming part of the insert assembly. The latch mechanism may be configured to latch the bearing assembly to the drill tool body. The delivery of the pressurized fluid to the removal volume may comprise pressurizing fluid already present in the removal volume, or may comprise filling the previously unoccupied removal volume with pressurized fluid. Delivery of pressurized fluid to the removal volume may be performed at least in part after the unlatching of the latch mechanism.

A common control fluid may be used for the delivery of pressurized fluid to the removal volume, and for causing the hydraulically actuated unlatching of latch mechanism. The pressurized fluid delivered to the removal volume may be a control fluid different from drilling fluid conveyed in the passage.

In other embodiments, the removal volume may be in fluid communication with a lubrication fluid circuit to supply lubrication fluid to the bearing assembly, in which case the delivery of pressurized fluid to the removal volume may comprise pressurizing bearing assembly lubrication fluid (e.g., lubrication oil) in the removal volume. In yet other embodiments, the pressurized fluid delivered to the removal volume may comprise a gasphase fluid, e.g. nitrogen gas.

The displacing of the insert assembly axially in the removal direction may comprise positively engaging the insert assembly with a removal tool (e.g. comprising a dedicated, specialized tool, or a drill pipe engaged with the sealing element), and exerting a removal force on the insert assembly in the removal direction synchronously with exertion of the net fluid pressure bias on the insert assembly by the pressurized fluid in the removal volume.

As mentioned above, the insert assembly may comprise an annulus sealing assembly (configured to sealingly receive an elongated drill string element (e.g., a drill pipe) extending axially therethrough, and being configured to seal an annular space defined between the drill string element and a peripheral wall of the passage, to restrict flow of drilling fluid from a downhole side of the annulus sealing assembly to an uphole side thereof. The drill tool body may form part of a rotating control device mounted uphole of a blowout preventer in a drilling installation.

The removal volume may be defined, at least in part, by one or more sealing members (e.g., by a static seal set) located radially between the insert assembly and the drill tool body, exertion of the net fluid pressure bias on the insert assembly being at least in part via the set of sealing members. in such a case, the pressurized fluid in the removal volume may act on the one or more sealing members such that the one or more sealing members exert a net axial force on the insert assembly in a removal direction. Such indirect application of the bias in the removal direction is understood to comprise a net fluid pressure bias, owing to origin of the bias in pressurized fluid in the removal volume.

In some embodiments, the removal volume may form part of a plurality of segregated hydraulic chambers defined between the tool insert and drill tool body, with fluid pressures in at least two of the hydraulic chambers being independently controllable to exert the net fluid pressure bias on the tool insert. One embodiment of such a multi-chamber hydraulic actuating system will briefly be described with reference to modifications to the earlier-described RCD 128 of FIG. 4. In a modification, a hydraulic chamber 606 located adjacent an upper seal set may form part of the lubrication/removal fluid circuit 504, being hydraulically connected to the pumpout control system 714.

In one embodiment, a differential area may be defined between the hydraulic chamber 606 and the removal volume 316, so that a net fluid pressure bias acting in removal direction 351 results from provision of identical fluid pressures in the removal volume 316 and the hydraulic chamber 606. In another embodiment, the hydraulic chamber 606 and the removal volume 316 may be pressurized independently, so that provision of a relatively higher pressure in the removal volume 316 results in exertion of a fluid pressure bias on the tool insert in the removal direction 351. In such an embodiment, the orientation of the pressure differential in the hydraulic chamber 606 and removal volume 316 may be selectively reversible, to cause a net fluid pressure bias that urges the tool insert in the downhole direction 311. The method may thus include, when removal of the tool insert is not desired, exerting a net fluid pressure bias on the tool insert a direction opposite to the removal direction 351.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A method comprising:

pressurizing a fluid in a removal volume defined between a drill tool body and a tool insert;

exerting a net fluid pressure bias on the tool insert in a first direction; and removing the tool insert from the drill tool body by moving the tool insert towards the first direction using the net fluid pressure bias.

2. The method of claim 1, wherein the tool insert comprises a bearing assembly to rotatably support one or more rotary components in a fluid passage in the drill tool body, the removal volume being located between the bearing assembly and the drill tool body such that the net fluid pressure bias is exerted on the bearing assembly.

3. The method of claim 2, wherein the bearing assembly comprises a substantially tubular bearing housing mounted co-axially in the fluid passage, the removal volume comprising an at least part-annular space that extends radially between the bearing housing and a peripheral wall of the fluid passage.

4. The method of claim 3, wherein the removal volume is in fluid communication with a lubrication fluid circuit to supply a lubrication fluid to the bearing assembly, the pressurizing of the fluid in the removal volume comprising pressurizing of the lubrication fluid.

5. The method of claim 1, further comprising unlatching a latch mechanism that axially anchors the tool insert to the drill tool body, thereby to permit axial removal of the tool insert from a fluid passage in the drill tool body under axial urging of at least the net fluid pressure bias.

6. The method of claim 5, wherein the unlatching of the latch mechanism comprises hydraulically actuated radially outward displacement of a plurality of latch members mounted on the drill tool body and projecting radially inwards into latching engagement with the tool insert.

7. The method of claim 1, wherein the fluid in the removal volume is a control fluid different from drilling fluid conveyed in a fluid passage in the drill tool body.

8. The method of claim 1, wherein removing the tool insert from the drill tool body comprises positively engaging the tool insert with a removal tool and exerting a removal force on the tool insert in the first direction synchronously with exertion of the net fluid pressure bias on the tool insert by the fluid in the removal volume.

9. The method of claim 1, wherein the drill tool body forms part of a rotating control device mounted uphole of a blowout preventer in a drilling installation.

10. The method of claim 1, wherein the removal volume is defined, at least in part, by one or more seals located radially between the tool insert and the drill tool body, exertion of the net fluid pressure bias on the tool insert being at least in part via the one or more seals.

11. A system comprising:

a drill tool body having a fluid passage;

a tool insert, wherein a portion of the tool insert forms removal volume that is defined between the tool insert and the drill tool body; and a fluid supply mechanism connected with the removal volume to deliver pressurized fluid to the removal volume, wherein filling the removal volume with the pressurized fluid exerts a net fluid pressure bias on the tool insert in a first direction.

12. The system of claim 11, wherein the tool insert comprises a bearing assembly to rotatably support one or more rotary components in the fluid passage, the removal volume being partially defined by the bearing assembly to cause exertion of the net fluid pressure bias on the bearing assembly.

13. The system of claim 12, wherein the bearing assembly comprises a substantially tubular bearing housing configured for co-axial mounting in the fluid passage such that the removal volume is partly defined by the bearing housing and comprises an at least part-annular space extending radially between the bearing housing and a peripheral wall of the fluid passage.

14. The system of claim 12, further comprising a lubrication fluid circuit to supply a lubrication fluid to the bearing assembly, the lubrication fluid circuit being in flow communication with the removal volume, wherein the fluid supply mechanism is configured to cause exertion of the net fluid pressure bias on the tool insert via lubrication fluid in the removal volume.

15. The system of claim 11, further comprising a latching mechanism coupled to the drill tool body and configured to be selectively disposal through hydraulic actuation between a latched condition in which the tool insert is axially anchored in the fluid passage, and an unlatched condition which permits removal of the tool insert from the fluid passage, wherein the latching mechanism and the fluid supply mechanism, wherein the latching mechanism and the fluid supply mechanism configured to use a same hydraulic medium.

16. The system of claim 15, further comprising a hydraulic control system configured automatically to cause hydraulically actuated unlatching of the latching mechanism, before causing exertion of the net fluid pressure bias on the tool insert.

17. The system of claim 11, wherein the fluid supply mechanism is configured to deliver pressurized gas to the removal volume.

18. The system of claim 11, wherein the tool insert comprises an annulus sealing assembly configured to sealingly receive an elongated drill string element extending axially therethrough, and being configured for sealing an annular space defined between the elongated drill string element and a peripheral wall of the fluid passage, to substantially prevent flow of drilling fluid from a downhole side of the annulus sealing assembly to an uphole side thereof.

19. The system of claim 11, further comprising a rotating control device of which the drill tool body forms part, the rotating control device being configured for mounting uphole of a blowout preventer in a drilling installation.

20. The system of claim 11, wherein the tool insert comprises a bore protector configured for mounting on the drill tool body to provide a temporary protective liner for a part of a peripheral wall of the fluid passage, the removal volume being defined between the bore protector and the peripheral wall of the fluid passage.

21. The system of claim 11, wherein an outer diameter of the tool insert has stepwise tapering, the stepwise tapering increasing a first cross-sectional area of the tool insert facing against the first direction relative to a second cross-sectional area of the tool insert facing towards the first direction, wherein both the first cross-sectional area and second cross-sectional area are exposed to the removal volume.

22. A system comprising:

a drill string having a fluid conduit;

a drill tool body concentric with the drill string, wherein the drill tool body has a fluid passage that is in fluid communication with the fluid conduit;

a tool insert, wherein a portion of the tool insert forms a removal volume that is defined between the tool insert and the drill tool body; and a fluid supply mechanism connected with the removal volume to deliver pressurized fluid to the removal volume, wherein filling the removal volume with the pressurized fluid exerts a net fluid pressure bias on the tool insert in a first direction.

* * * * *